US007628904B2

(12) United States Patent
Strezov et al.

(10) Patent No.: US 7,628,904 B2
(45) Date of Patent: Dec. 8, 2009

(54) MINIMISING CARBON TRANSFER IN AN ELECTROLYTIC CELL

(75) Inventors: Les Strezov, Adamstown (AU); Ivan Ratchev, New South Wales (AU); Steve Osborn, Valentine (AU); Sergey Alexander Bliznyukov, Jesmond (AU)

(73) Assignee: Metalysis Limited (GB)

( * ) Notice: Subject to any disclaimer, the term of this patent is extended or adjusted under 35 U.S.C. 154(b) by 853 days.

(21) Appl. No.: 10/531,650

(22) PCT Filed: Oct. 15, 2003

(86) PCT No.: PCT/AU03/01364

§ 371 (c)(1),
(2), (4) Date: Feb. 21, 2006

(87) PCT Pub. No.: WO2004/035873

PCT Pub. Date: Apr. 29, 2004

(65) Prior Publication Data

US 2006/0180462 A1 Aug. 17, 2006

(30) Foreign Application Priority Data

Oct. 16, 2002 (AU) ..... 2002952083

(51) Int. Cl.
*C25C 3/28* (2006.01)
*C25C 7/04* (2006.01)

(52) U.S. Cl. ..... 205/400; 204/243.1; 204/247.4

(58) Field of Classification Search ..... 205/377, 205/400

See application file for complete search history.

(56) References Cited

U.S. PATENT DOCUMENTS 5,006,209 A 4/1991 Beck et al.

(Continued)

FOREIGN PATENT DOCUMENTS

WO WO 99/64638 A1 * 12/1999

(Continued)

OTHER PUBLICATIONS

English Translation of Russian Office Action dated Jan. 19, 2009 relating to Russian Appln. No. 2006137273/02 (040574) filed Mar. 22, 2005 based upon PCT/AU2005/000409 corresponding to U.S. Appl. No. 11/522,761, filed Sep. 18, 2006.

*Primary Examiner*—Harry D Wilkins, III
(74) *Attorney, Agent, or Firm*—Brinks Hofer Gilson & Lione; G. Peter Nichols

(57) ABSTRACT

An electrochemical cell for electrochemical reduction of a metal oxide in a solid state is disclosed. The cell includes a molten electrolyte (14), an anode (10) formed from carbon in contact with the electrolyte, a cathode (20) formed at least in part from the metal oxide in contact with the electrolyte, and a membrane (28) that is permeable to oxygen anions and is impermeable to carbon in ionic and non-ionic forms positioned between the cathode and the anode to thereby prevent migration of carbon from the anode to the cathode. The membrane includes a body (32) and a lining (34) on the surface of the body on the cathode side of the membrane. The lining is formed from a material that is inert with respect to dissolved metal in the electrolyte and is impermeable to the dissolved metal. An electrochemical method based on the cell is also disclosed.

13 Claims, 1 Drawing Sheet

U.S. PATENT DOCUMENTS

| | | | | |
|---|---|---|---|---|
| 5,064,513 | A * | 11/1991 | Boutin et al. | 205/367 |
| 5,089,094 | A | 2/1992 | Ogasawara et al. | |
| 5,976,345 | A * | 11/1999 | Pal et al. | 205/336 |
| 6,187,168 | B1 * | 2/2001 | LaCamera et al. | 205/367 |
| 6,540,902 | B1 | 4/2003 | Redey et al. | |
| 6,663,763 | B2 * | 12/2003 | Strezov et al. | 205/367 |
| 6,712,952 | B1 * | 3/2004 | Fray et al. | 205/640 |
| 6,811,678 | B2 * | 11/2004 | Strezov et al. | 205/403 |
| 7,208,075 | B2 * | 4/2007 | Strezov et al. | 205/367 |
| 7,504,017 | B2 * | 3/2009 | Cardarelli | 205/398 |
| 2003/0173228 | A1 * | 9/2003 | Strezov et al. | 205/401 |
| 2004/0237711 | A1 | 12/2004 | Ono et al. | |
| 2005/0050989 | A1 | 3/2005 | Osborn et al. | |
| 2005/0092129 | A1 * | 5/2005 | Strezov et al. | 75/10.23 |
| 2006/0191799 | A1 | 8/2006 | Strezov et al. | |
| 2006/0226027 | A1 | 10/2006 | Shook et al. | |
| 2007/0131560 | A1 | 6/2007 | Ratchev et al. | |
| 2007/0181438 | A1 | 8/2007 | Olivares et al. | |
| 2007/0193877 | A1 | 8/2007 | Rigby et al. | |
| 2007/0251833 | A1 | 11/2007 | Ratchev et al. | |
| 2008/0047845 | A1 | 2/2008 | Rigby et al. | |
| 2008/0149495 | A1 | 6/2008 | Mukunthan et al. | |

FOREIGN PATENT DOCUMENTS

| | | | |
|---|---|---|---|
| WO | WO 02/083989 | A1 | 10/2002 |
| WO | WO 02/083993 | A1 | 10/2002 |
| WO | WO03/002785 | | 1/2003 |
| WO | WO 03/076690 | A1 | 9/2003 |
| WO | WO 03/076692 | A1 | 9/2003 |
| WO | WO 2004/033760 | A2 | 4/2004 |
| WO | WO 2004/035873 | A1 | 4/2004 |

* cited by examiner

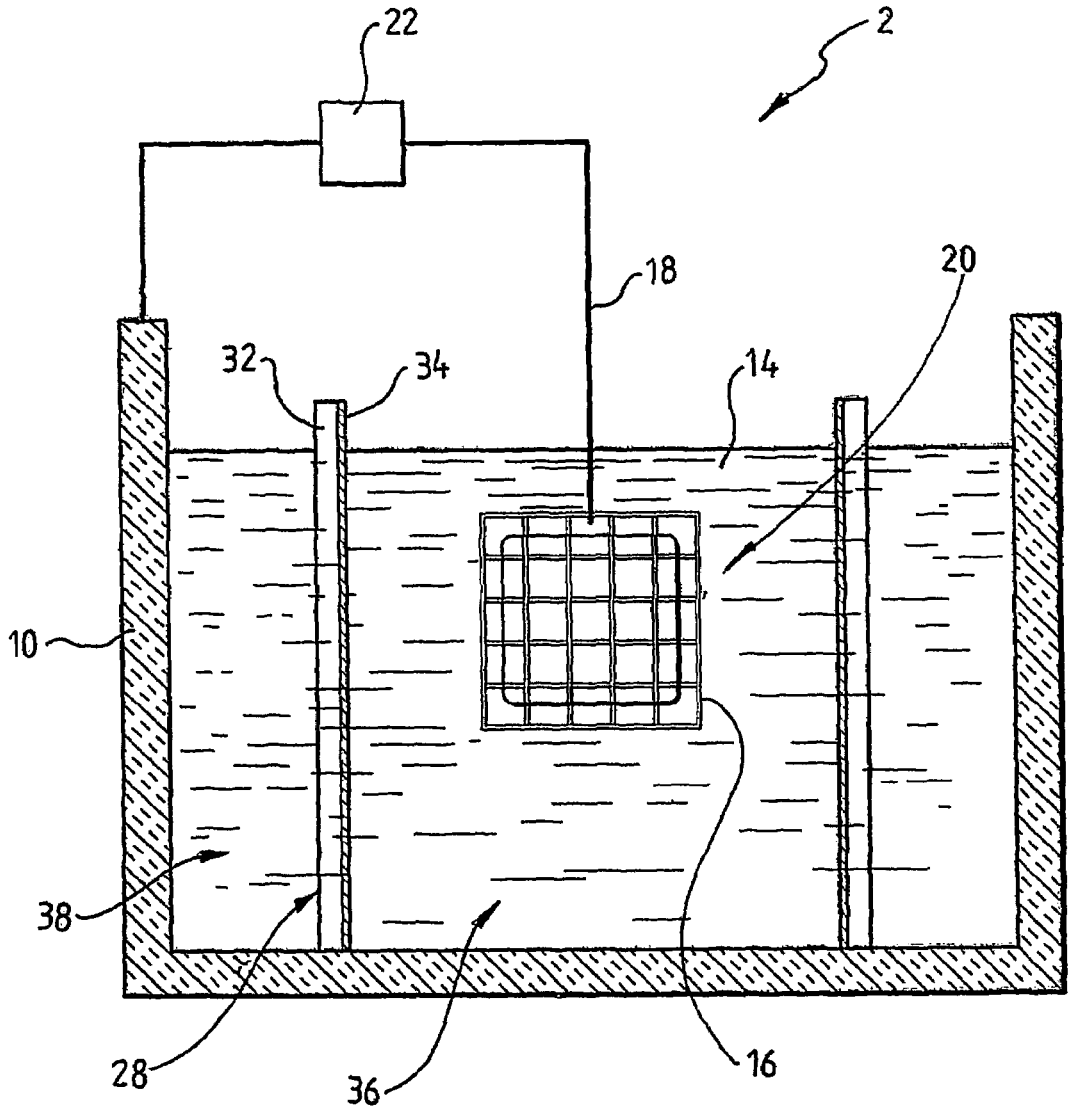
22
2
18
20
32
34
14
10
38
28
36
16

MINIMISING CARBON TRANSFER IN AN ELECTROLYTIC CELL

The present invention relates to electrochemical reduction of metal oxides.

The present invention was made during the course of an on-going research project on electrochemical reduction of metal oxides being carried out by the applicant. The research project has focused on the reduction of titania ($TiO_2$).

During the course of the research project the applicant carried out experimental work on the reduction of titania using electrolytic cells that included a pool of molten $CaCl_2$-based electrolyte, an anode formed from graphite, and a range of cathodes.

The $CaCl_2$-based electrolyte was a commercially available source of $CaCl_2$, namely calcium chloride dihydrate, that decomposed on heating and produced a very small amount of CaO.

The applicant operated the electrolytic cells at potentials above the decomposition potential of CaO and below the decomposition potential of $CaCl_2$.

The applicant found that at these potentials the cells could electrochemically reduce titania to titanium with low concentrations of oxygen, ie concentrations less than 0.2 wt %.

The applicant does not have a clear understanding of the electrolytic cell mechanism at this stage.

Nevertheless, whilst not wishing to be bound by the comments in the following paragraphs, the applicant offers the following comments by way of an outline of a possible cell mechanism.

The experimental work carried out by the applicant produced evidence of Ca metal dissolved in the electrolyte. The applicant believes that the Ca metal was the result of electrodeposition of $Ca^{++}$ cations as Ca metal on the cathode.

As is indicated above, the experimental work was carried out using a $CaCl_2$-based electrolyte at a cell potential below the decomposition potential of $CaCl_2$. The applicant believes that the initial deposition of Ca metal on the cathode was due to the presence of $Ca^{++}$ cations and $O^{--}$ anions derived from CaO in the electrolyte. The decomposition potential of CaO is less than the decomposition potential of $CaCl_2$. In this cell mechanism the cell operation is dependent on decomposition of CaO, with $Ca^{++}$ cations migrating to the cathode and depositing as Ca metal and $O^{--}$ anions migrating to the anode and forming CO and/or $CO_2$ (in a situation in which the anode is a graphite anode) and releasing electrons that facilitate electrolytic deposition of Ca metal on the cathode.

The applicant believes that the Ca metal that deposits on the cathode participates in chemical reduction of titania resulting in the release of $O^{--}$ anions from the titania.

The applicant also believes that the $O^{--}$ anions, once extracted from the titania, migrate to the anode and react with anode carbon and produce CO and/or $CO_2$ (and in some instances CaO) and release electrons that facilitate electrolytic deposition of Ca metal on the cathode.

However, notwithstanding that the cell could electrochemically reduce titania to titanium with very low concentrations of oxygen, the applicant also found that there were relatively significant amounts of carbon transferred from the anode to the electrolyte and to the titanium produced at the cathode under a wide range of cell operating conditions. Carbon in the titanium is an undesirable contaminant. In addition, carbon transfer was responsible for low current efficiency of the cell because of back reactions involving calcium metal that is dissolved in the electrolyte and CO and/or $CO_2$ gas that is generated at the anode. Both of these problems are significant barriers to commercialisation of the electrochemical reduction technology.

The applicant carried out experimental work to identify the mechanism for carbon transfer and to determine how to minimise carbon transfer and/or to minimise the adverse effects of carbon transfer.

The experimental work indicated that the mechanism of carbon transfer is electrochemical rather than erosion and that one way of minimising carbon transfer, and therefore minimising contamination of titanium produced at the cathode by electrochemical reduction of titania at the cathode, is to position a membrane between the anode and the cathode that is:

(a) impermeable to carbon in ionic and non-ionic forms to prevent migration of carbon from the anode to the cathode, and (b) permeable to oxygen anions so that the anions can migrate from the cathode to the anode.

International application PCT/AU03/00305 (WO 03/076692) in the name of the applicant describes and claims this invention.

Specifically, the International application describes and claims an invention of an electrolytic cell for electrochemical reduction of a metal oxide, such as titania, in a solid state, which electrolytic cell includes an anode formed from carbon, a cathode formed at least in part from the metal oxide, and a membrane that is permeable to oxygen anions and is impermeable to carbon in ionic and non-ionic forms positioned between the cathode and the anode to thereby prevent migration of carbon to the cathode.

In the course of experimental work on a membrane made of yttria stabilised zirconia the applicant noted that, over time, there was break-down of sections of the membrane in direct contact with the electrolyte. This a potentially serious problem.

The applicant believes that the break-down may be due to reduction of zirconia by calcium metal dissolved in the electrolyte. The applicant also believes that there may be no discernible reduction of yttria by calcium or other constituents of the electrolyte.

As a consequence of the above, the present invention provides an electrochemical cell for electrochemical reduction of a metal oxide in a solid state, which electrochemical cell includes a molten electrolyte, an anode formed from carbon in contact with the electrolyte, a cathode formed at least in part from the metal oxide in contact with the electrolyte, and a membrane that is permeable to oxygen anions and is impermeable to carbon in ionic and non-ionic forms positioned between the cathode and the anode to thereby prevent migration of carbon from the anode to the cathode, the membrane includes a body and a lining on the surface of the body on the cathode side of the membrane, and the lining is formed from a material that is inert with respect to dissolved metal in the electrolyte and is impermeable to the dissolved metal.

In a situation in which the metal oxide is titania it is preferred that the electrolyte be a $CaCl_2$-based electrolyte that includes CaO. In this situation the dissolved metal is calcium metal. In this situation preferably the lining is formed from a material that is inert and impermeable with respect to calcium metal.

Preferably the anode is formed from graphite.

The membrane may be formed from any suitable material(s).

Preferably the body of the membrane is formed from a solid electrolyte that is permeable to oxygen anions and is impermeable to carbon in ionic and non-ionic forms.

Preferably the solid electrolyte is an oxide.

One solid electrolyte tested by the applicant is yttria stabilised zirconia.

The lining may be formed from any suitable material that is inert with respect to dissolved metal in the electrolyte and is impermeable to the dissolved metal.

Preferably the lining is formed from an oxide.

Preferably the material of the lining is a rare earth oxide.

More preferably the rare earth oxide is yttria.

Preferably the lining is continuous and covers all of the surface of the body of the membrane that would otherwise be in contact with the electrolyte so that there are no sections of the body that are in contact with the electrolyte on the cathode side of the membrane.

Preferably, the cathode also includes an electrical conductor.

The present invention also provides a method of electrochemical reduction of a metal oxide using the above-described electrochemical cell.

Preferably the method includes a step of operating the cell at a potential that is above a decomposition potential of at least one of the constituents of the electrolyte so that there are cations of a metal other than that of the metal oxide in the electrolyte.

In a situation in which the metal oxide is a titanium oxide, such as titania, it is preferred that the electrolyte be a $CaCl_2$-based electrolyte that includes CaO as one of the constituents.

In such a situation it is preferred that the cell potential be above the decomposition potential for CaO.

It is preferred that the cell potential be above 1.5 V.

The $CaCl_2$-based electrolyte may be a commercially available source of $CaCl_2$, such as calcium chloride dihydrate, that partially decomposes on heating and produces CaO or otherwise includes CaO.

Alternatively, or in addition, the $CaCl_2$-based electrolyte may include $CaCl_2$ and CaO that are added separately or pre-mixed to form the electrolyte.

The present invention is described further with reference to the accompanying drawing which illustrates in schematic form an embodiment of an electrochemical cell in accordance with the present invention.

Whilst the following description relates to electrochemical reduction of titania, the basic principle is equally applicable to other metal oxides, in particular oxides of silicon and germanium or alloys containing these metals.

The cell includes a graphite crucible 10 that forms an anode 10 of the cell, a pool 14 of molten $CaCl_2$_ based electrolyte that contains at least some CaO in the crucible, and a basket 16 of titania pellets connected to a lower end of a Kanthal or stainless steel wire 18 that form a cathode 20 of the cell.

The molten electrolyte contacts the anode 10 and the cathode 22.

The cell further includes a power source 22 and electrical connections between the power source 22 and the anode 10 and the cathode 20.

The electrical connections include the above-described wire 18 and an electrically conductive wire that connects the power source 22 and the anode 10.

The cell further includes a membrane 28 that is positioned between the anode 10 and the cathode 20. The membrane divides the cell into an cathode chamber 36 and an anode chamber 38.

The membrane includes a body 32 of yttria stabilised zirconia and an inner lining 34 of yttria, ie a lining on the cathode side of the membrane 28.

Yttria stabilised zirconia and yttria are permeable to oxygen anions and therefore the membrane 28 does not interfere with migration of oxygen anions from the cathode 20 to the anode 10.

Yttria stabilised zirconia is more conductive than yttria to oxygen anions and, therefore, it is preferred that the lining 34 be relatively thin—although sufficiently thick to operate effectively as a barrier to calcium metal.

In addition, yttria is inert with respect to the constituents of the electrolyte (including dissolved calcium metal in the electrolyte) and is impermeable to calcium metal. The yttria lining 34 is provided to prevent contact between calcium metal in the cathode chamber 36 and yttria stabilised zirconia of the body 32.

In use, the above-described electrolytic cell 2 is positioned in a suitable furnace to maintain the electrolyte in a molten state.

Preferably the atmosphere around the crucible 10 is an inert gas, such as argon, that does not react with the molten electrolyte.

Once the cell reaches its operating temperature, a preselected voltage above the decomposition potential of CaO in the electrolyte and preferably below the decomposition potential of $CaCl_2$ in the electrolyte is applied to the cell, whereby reduction of the titania in the cathode 20 is carried out as described above.

The oxygen anions that pass into the electrolyte 14 by virtue of electrochemical reduction of the metal oxide migrate to the anode 10 via the electrolyte and by passing through the membrane 28. The oxygen anions give up electrons at the anode 10 and $CO/CO_2$ gas evolves at the anode 10.

The membrane 32 prevents calcium metal within the cathode chamber 36 migrating into the anode chamber 38 and thereby avoids undesirable back reaction of calcium metal and $CO/CO_2$.

In addition, the yttria lining 34 of the membrane 32 prevents the calcium metal contacting and breaking down the zirconia in the body 32 of the membrane 28.

Many modifications may be made to the present invention as described above without departing from the spirit and scope of the invention.

By way of example, whilst the above description of the invention focuses on electrochemical reduction of titania, the invention is not so limited and extends to electrochemical reduction of other titanium oxides and to oxides of other metals and alloys.

Examples of other potentially important meals are aluminum, silicon, germanium, hafnium, magnesium, and molybdenum.

Furthermore, whilst the above description of the invention focuses on $CaCl_2$-based electrolyte, the invention is not so limited and extends to any other suitable electrolytes. Generally, suitable electrolytes will be salts and oxides that are soluble in salts. One example of a potentially suitable electrolyte is $BaCl_2$.

Furthermore, whilst the above description of the embodiment of the invention shown in the drawing describes yttria as the inner lining 34 of the membrane 28, the invention is not do limited and extends to any suitable material that is inert with respect to dissolved metal in the electrolyte and is impermeable to the dissolved metal.

Furthermore, whilst the above description of the embodiment of the invention shown in the drawing describes that the cell crucible is the anode 10, the invention is not so limited and extends to other arrangements, such as arrangements in which the crucible is formed from a non-reactive material in relation to the process and the anode is a member, such as a graphite rod that extends into the cell.

The invention claimed is:

1. An electrochemical cell for electrochemical reduction of a metal oxide in a solid state includes: a molten electrolyte, an anode formed from carbon in contact with the electrolyte, a cathode formed at least in part from the metal oxide in contact with the electrolyte, and a membrane that is permeable to oxygen anions and is impermeable to carbon in ionic and non-ionic forms positioned between the cathode and the anode to thereby prevent migration of carbon from the anode to the cathode, the membrane includes a body and a lining on the surface of the body on the cathode side of the membrane, and the lining is formed from a material that is inert with respect to dissolved metal in the electrolyte and is impermeable to the dissolved metal.

2. The cell defined in claim 1 wherein, in a situation in which the metal oxide is titania and the electrolyte is a $CaCl_2$-based electrolyte that includes CaO whereby the dissolved metal is calcium metal, the lining is formed from a material that is inert and impermeable with respect to calcium metal.

3. The cell defined in claim 1 wherein the anode is formed from graphite.

4. The cell defined in claim 1 wherein the body of the membrane is formed from a solid electrolyte.

5. The cell defined in claim 4 wherein the solid electrolyte is an oxide.

6. The cell defined in claim 5 wherein the oxide is yttria stabilised zirconia.

7. The cell defined in claim 1 wherein the lining is formed from an oxide.

8. The cell defined in claim 7 wherein the lining is formed from a rare earth oxide.

9. The cell defined in claim 8 wherein the rare earth oxide is yttria.

10. The cell defined in claim 1 wherein the lining is continuous and covers all of the surface of the body of the membrane that would otherwise be in contact with the electrolyte so that there are no sections of the body that are in contact with the electrolyte on the cathode side of the membrane.

11. The cell defined in claim 1 wherein the cathode also includes an electrical conductor.

12. A method of electrochemically reducing a metal oxide includes a step of operating the cell defined in any one of the preceding claims at a potential that is above a decomposition potential of at least one of the constituents of the electrolyte so that there are cations of a metal other than that of the metal oxide in the electrolyte.

13. The method defined in claim 12 wherein, in a situation in which the metal oxide is a titanium oxide and the electrolyte is a $CaCl_2$-based electrolyte that includes CaO as one of the constituents, the cell potential is a potential above that the decomposition potential for CaO.

* * * * *

UNITED STATES PATENT AND TRADEMARK OFFICE

CERTIFICATE OF CORRECTION

PATENT NO. : 7,628,904 B2
APPLICATION NO. : 10/531650
DATED : December 8, 2009
INVENTOR(S) : Strezov et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 962 days.

Signed and Sealed this

Second Day of November, 2010

David J. Kappos

David J. Kappos
*Director of the United States Patent and Trademark Office*